US011799204B2

(12) United States Patent
Chang et al.

(10) Patent No.: US 11,799,204 B2
(45) Date of Patent: Oct. 24, 2023

(54) CONVERTIBLE NOTEBOOK COMPUTER

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/702,477

(22) Filed: Mar. 23, 2022

(65) Prior Publication Data

US 2023/0107295 A1 Apr. 6, 2023

(30) Foreign Application Priority Data

Oct. 6, 2021 (TW) ..... 110137146

(51) Int. Cl.
*H01Q 5/385* (2015.01)
*H01Q 13/10* (2006.01)
*H01Q 1/22* (2006.01)

(52) U.S. Cl.
CPC ..... *H01Q 5/385* (2015.01); *H01Q 1/2266* (2013.01); *H01Q 13/10* (2013.01)

(58) Field of Classification Search
CPC ..... H01Q 5/385; H01Q 1/2266; H01Q 13/10
See application file for complete search history.

(56) References Cited

U.S. PATENT DOCUMENTS 9,668,556 B2 6/2017 Senatori
10,454,156 B1 * 10/2019 Yang ..... H01Q 1/48
11,095,032 B2 * 8/2021 Tseng ..... H01Q 13/10
2013/0257660 A1 * 10/2013 Wong ..... H01Q 5/371 343/702

(Continued)

FOREIGN PATENT DOCUMENTS

TW I646727 B 1/2019
TW I669593 B 8/2019

(Continued)

OTHER PUBLICATIONS

Chinese language office action dated Apr. 25, 2022, issued in application No. TW 110137146.

*Primary Examiner* — Ab Salam Alkassim, Jr.
*Assistant Examiner* — Anh N Ho
(74) *Attorney, Agent, or Firm* — McClure, Qualey & Rodack, LLP

(57) ABSTRACT

A convertible notebook computer includes a metal mechanism element, a first radiation element, a second radiation element, a third radiation element, a first parasitic element, a second parasitic element, a third parasitic element, and a dielectric substrate. The metal mechanism element has a closed slot. The first radiation element has a feeding point. The second radiation element is coupled to the first radiation element. The third radiation element is coupled to the first radiation element. The first parasitic element is adjacent to the second radiation element. The second parasitic element is adjacent to the third radiation element. The third parasitic element is adjacent to the first radiation element. An antenna structure is formed by the closed slot of the metal mechanism element, the first radiation element, the second radiation element, the third radiation element, the first parasitic element, the second parasitic element, and the third parasitic element.

15 Claims, 7 Drawing Sheets

(56) References Cited

U.S. PATENT DOCUMENTS

| | | | | |
|---|---|---|---|---|
| 2014/0062798 | A1* | 3/2014 | Lin | H01Q 9/42 343/702 |
| 2014/0176378 | A1* | 6/2014 | Yu | H01Q 21/30 343/767 |
| 2017/0264002 | A1* | 9/2017 | Yen | H01Q 9/26 |
| 2018/0040942 | A1* | 2/2018 | Lepe | H01Q 13/106 |
| 2019/0198975 | A1* | 6/2019 | Chen | H01Q 9/42 |
| 2019/0214721 | A1* | 7/2019 | Hu | H01Q 5/385 |
| 2020/0168993 | A1* | 5/2020 | Wei | H01Q 1/24 |
| 2020/0274230 | A1* | 8/2020 | Wei | H01Q 5/357 |
| 2021/0167499 | A1* | 6/2021 | Tseng | H01Q 5/385 |
| 2021/0249776 | A1* | 8/2021 | Wei | H01Q 5/328 |

FOREIGN PATENT DOCUMENTS

| | | | |
|---|---|---|---|
| TW | M596981 U | * | 6/2020 |
| TW | I715316 B | | 1/2021 |

* cited by examiner

CONVERTIBLE NOTEBOOK COMPUTER

CROSS REFERENCE TO RELATED APPLICATIONS

This application claims priority of Taiwan Patent Application No. 110137146 filed on Oct. 6, 2021, the entirety of which is incorporated by reference herein.

BACKGROUND OF THE INVENTION

Field of the Invention

The disclosure generally relates to a convertible notebook computer, and more particularly, it relates to a convertible notebook computer and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the operation of antennas used for wireless communication in the mobile devices, thereby degrading the overall communication quality of the mobile devices. As a result, there is a need to propose a novel mobile device with a novel antenna structure, so as to overcome the problems of the prior art.

BRIEF SUMMARY OF THE INVENTION

In an exemplary embodiment, the disclosure is directed to a convertible notebook computer that includes a metal mechanism element, a first radiation element, a second radiation element, a third radiation element, a first parasitic element, a second parasitic element, a third parasitic element, and a dielectric substrate. The metal mechanism element has a closed slot. The first radiation element has a feeding point. The second radiation element is coupled to the first radiation element. The third radiation element is coupled to the first radiation element. The third radiation element and the second radiation element substantially extend in opposite directions. The first parasitic element is coupled to a first connection point on the metal mechanism element, and is disposed adjacent to the second radiation element. The second parasitic element is coupled to a second connection point on the metal mechanism element, and is disposed adjacent to the third radiation element. The third parasitic element is coupled to a third connection point on the metal mechanism element, and is disposed adjacent to the first radiation element. The first radiation element, the second radiation element, the third radiation element, the first parasitic element, the second parasitic element, and the third parasitic element are disposed on the dielectric substrate. An antenna structure is formed by the closed slot of the metal mechanism element, the first radiation element, the second radiation element, the third radiation element, the first parasitic element, the second parasitic element, and the third parasitic element.

In some embodiments, the whole dielectric substrate is inside the closed slot of the metal mechanism element.

In some embodiments, the combination of the first radiation element, the second radiation element, and the third radiation element substantially has a T-shape.

In some embodiments, a first coupling gap is formed between the first parasitic element and the second radiation element. A second coupling gap is formed between the second parasitic element and the third radiation element. A third coupling gap is formed between the third parasitic element and the first radiation element. The width of each of the first coupling gap, the second coupling gap, and the third coupling gap is shorter than or equal to 2 mm.

In some embodiments, the antenna structure covers a first frequency band and a second frequency band. The first frequency band is from 2400 MHz to 2500 MHz. The second frequency band is from 5150 MHz to 5850 MHz.

In some embodiments, the length of the closed slot of the metal mechanism element is substantially equal to 0.5 wavelength of the first frequency band.

In some embodiments, the total length of the first radiation element and the second radiation element is substantially equal to 0.25 wavelength of the first frequency band.

In some embodiments, the total length of the first radiation element and the third radiation element is substantially equal to 0.25 wavelength of the second frequency band.

In some embodiments, the convertible notebook computer further includes an upper cover housing, a display frame, a keyboard frame, a base housing, and a supporting and rotating arm. The convertible notebook computer operates in different modes by using the supporting and rotating arm.

In some embodiments, the metal mechanism element is disposed on the supporting and rotating arm. The closed slot is used as an antenna window. The radiation efficiency of the antenna structure is maintained at an acceptable level when the convertible notebook computer operates in a tablet mode.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
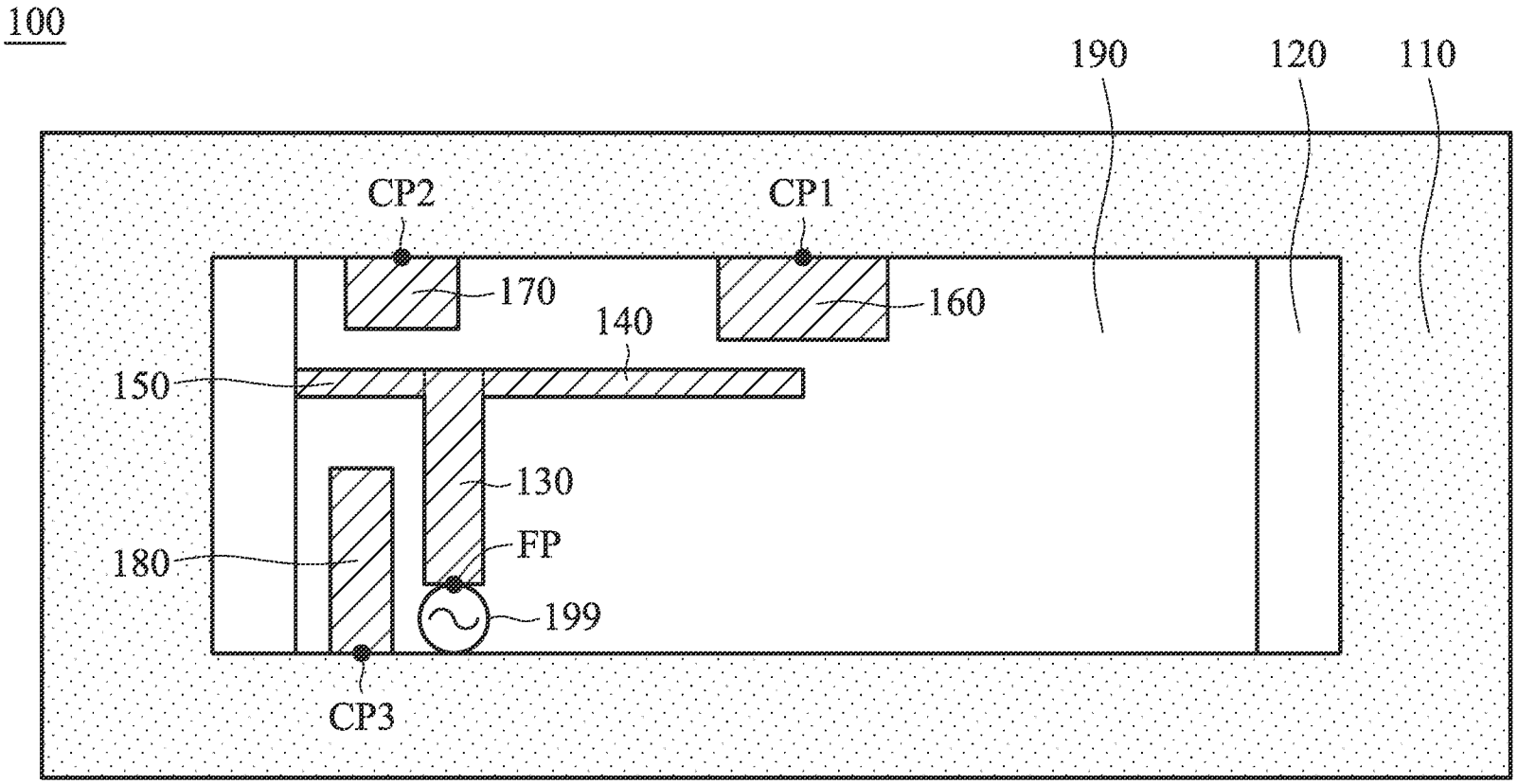
FIG. 1 is a top view of a convertible notebook computer according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
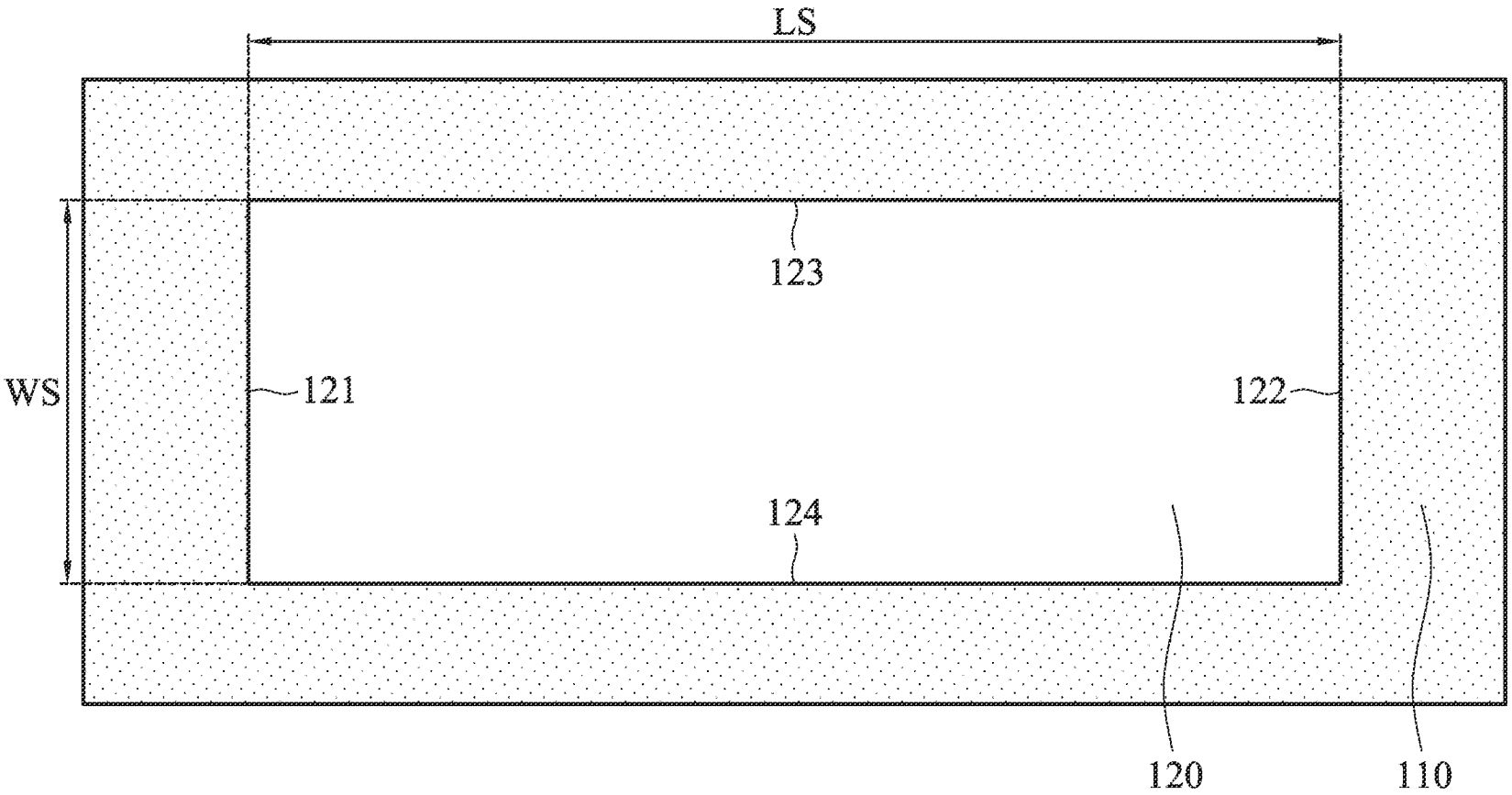
FIG. 2 is a top view of partial elements of a convertible notebook computer according to an embodiment of the invention.
Figure 3:
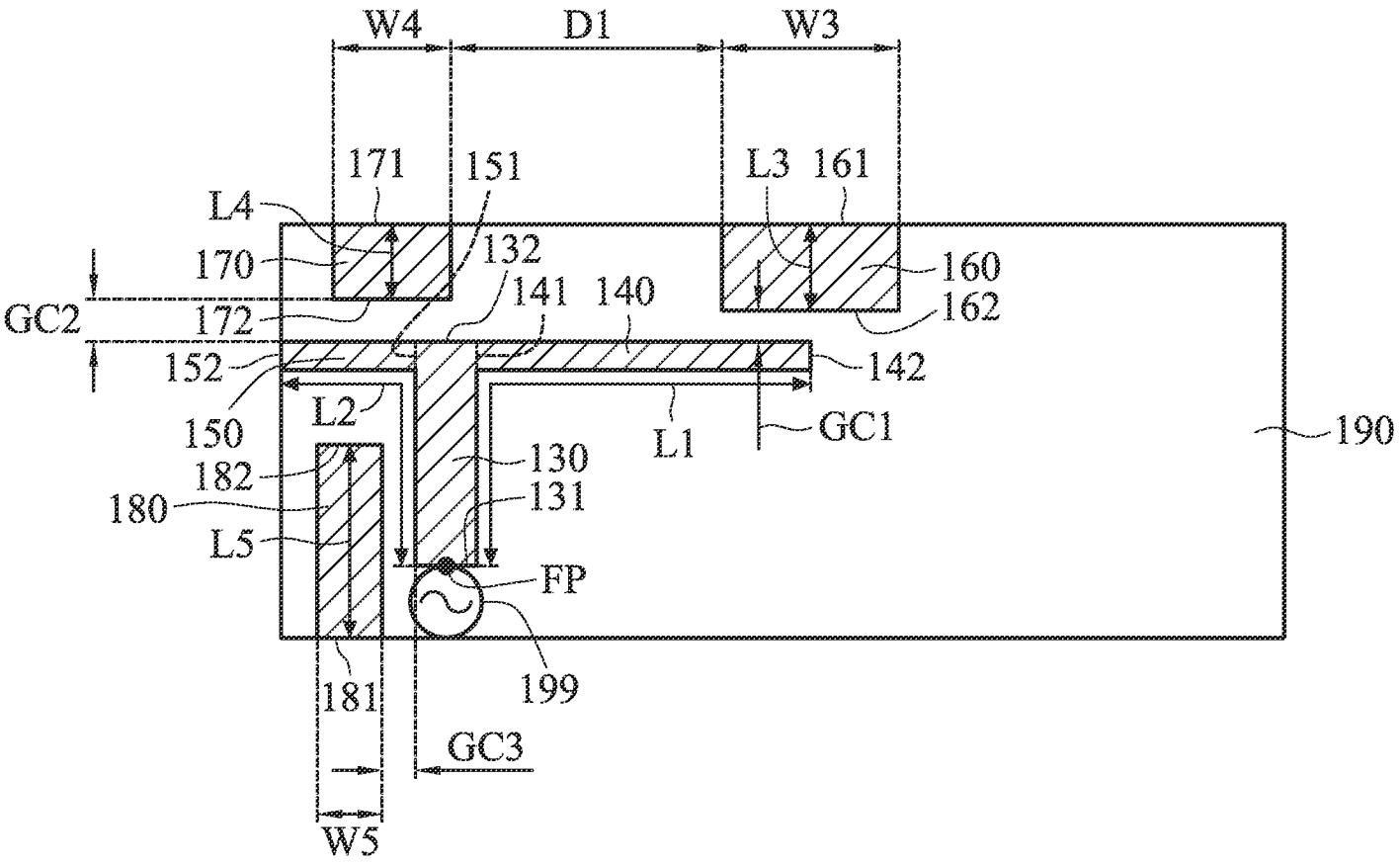
FIG. 3 is a top view of other partial elements of a convertible notebook computer according to an embodiment of the invention.

FIG. 1 is a top view of a convertible notebook computer 100 according to an embodiment of the invention. FIG. 2 is a top view of partial elements of the convertible notebook computer 100 according to an embodiment of the invention. FIG. 3 is a top view of other partial elements of the convertible notebook computer 100 according to an embodiment of the invention. Please refer to FIG. 1, FIG. 2 and FIG. 3 together. In the embodiment of FIG. 1, FIG. 2 and FIG. 3, the convertible notebook computer 100 includes a metal mechanism element 110, a first radiation element 130, a second radiation element 140, a third radiation element 150, a first parasitic element 160, a second parasitic element 170, a third parasitic element 180, and a dielectric substrate 190. The first radiation element 130, the second radiation element 140, the third radiation element 150, the first parasitic element 160, the second parasitic element 170, and the third parasitic element 180 may all be made of metal materials, such as copper, silver, aluminum, iron, or their alloys. It should be understood that the convertible notebook computer 100 may further include other components, such as a processor, a touch control panel, a speaker, a battery module, and a housing, although they are not displayed in FIG. 1, FIG. 2 and FIG. 3.

The metal mechanism element 110 may be an appearance element of the convertible notebook computer 100, and it may provide a ground voltage. It should be noted that the so-called "appearance element" over the disclosure means a portion of the convertible notebook computer 100 which eyes of users can directly observe. The metal mechanism element 110 has a closed slot 120. For example, the closed slot 120 may substantially have a rectangular shape, but it is not limited thereto. Specifically, the closed slot 120 has a first closed end 121 and a second closed end 122 which are away from each other, and a first edge 123 and a second edge 124 which are opposite to each other. In some embodiments, the closed slot 120 of the metal mechanism element 110 is used as an antenna window, such that electromagnetic waves can be transmitted through the antenna window.

The first radiation element 130 may substantially have a straight-line shape. Specifically, the first radiation element 130 has a first end 131 and a second end 132. A feeding point FP is positioned at the first end 131 of the first radiation element 130. The feeding point FP may be further coupled to a signal source 199. For example, the signal source 199 may be an RF (Radio Frequency) module for exciting an antenna structure of the convertible notebook computer 100.

The second radiation element 140 may substantially have a relatively long straight-line shape, which may be substantially perpendicular to the first radiation element 130. Specifically, the second radiation element 140 has a first end 141 and a second end 142. The first end 141 of the second radiation element 140 is coupled to the second end 132 of the first radiation element 130. The second end 142 of the second radiation element 140 is an open end.

The third radiation element 150 may substantially have a relatively short straight-line shape, which may be substantially perpendicular to the first radiation element 130. Specifically, the third radiation element 150 has a first end 151 and a second end 152. The first end 151 of the third radiation element 150 is coupled to the second end 132 of the first radiation element 130. The second end 152 of the third radiation element 150 is an open end. The second end 152 of the third radiation element 150 and the second end 142 of the second radiation element 140 may substantially extend in opposite directions and away from each other. In some embodiments, the combination of the first radiation element 130, the second radiation element 140, and the third radiation element 150 substantially has a T-shape.

The first parasitic element 160 may substantially have a rectangular shape. The first parasitic element 160 has a first end 161 and a second end 162. The first end 161 of the first parasitic element 160 is coupled to a first connection point CP1 on the metal mechanism element 110. The second end 162 of the first parasitic element 160 is an open end, which is adjacent to the second radiation element 140. It should be noted that the term "adjacent" or "close" over the disclosure means that the distance (spacing) between two corresponding elements is smaller than a predetermined distance (e.g., 5 mm or shorter), but often does not mean that the two corresponding elements directly touch each other (i.e., the aforementioned distance/spacing therebetween is reduced to 0). In some embodiments, a first coupling gap GC1 is formed between the first parasitic element 160 and the second radiation element 140.

The second parasitic element 170 may substantially have another rectangular shape. The second parasitic element 170 has a first end 171 and a second end 172. The first end 171 of the second parasitic element 170 is coupled to a second connection point CP2 on the metal mechanism element 110. The second end 172 of the second parasitic element 170 is an open end, which is adjacent to the third radiation element 150. In some embodiments, a second coupling gap GC2 is formed between the second parasitic element 170 and the third radiation element 150.

The third parasitic element 180 may substantially have another straight-line shape. The third parasitic element 180 has a first end 181 and a second end 182. The first end 181 of the third parasitic element 180 is coupled to a third connection point CP3 on the metal mechanism element 110. The second end 182 of the third parasitic element 180 is an open end, which is adjacent to the first radiation element 130. In some embodiments, a third coupling gap GC3 is formed between the third parasitic element 180 and the first radiation element 130. For example, the first connection point CP1 and the second connection point CP2 may both be positioned at the first edge 123 of the closed slot 120, and the third connection point CP3 may be positioned at the second edge 124 of the closed slot 120, but they are not limited thereto.

The dielectric substrate 190 may be a PCB (Printed Circuit Board) or an FPC (Flexible Printed Circuit). The first radiation element 130, the second radiation element 140, the third radiation element 150, the first parasitic element 160, the second parasitic element 170, and the third parasitic element 180 may all be disposed on the same surface of the dielectric substrate 190. The whole dielectric substrate 190 is inside the closed slot 120 of the metal mechanism element 110. For example, the dielectric substrate 190 may touch both of the first edge 123 and the second edge 124 of the closed slot 120.

In a preferred embodiment, an antenna structure of the convertible notebook computer 100 is formed by the closed slot 120 of the metal mechanism element 110, the first radiation element 130, the second radiation element 140, the third radiation element 150, the first parasitic element 160, the second parasitic element 170, and the third parasitic element 180.

Figure 4:
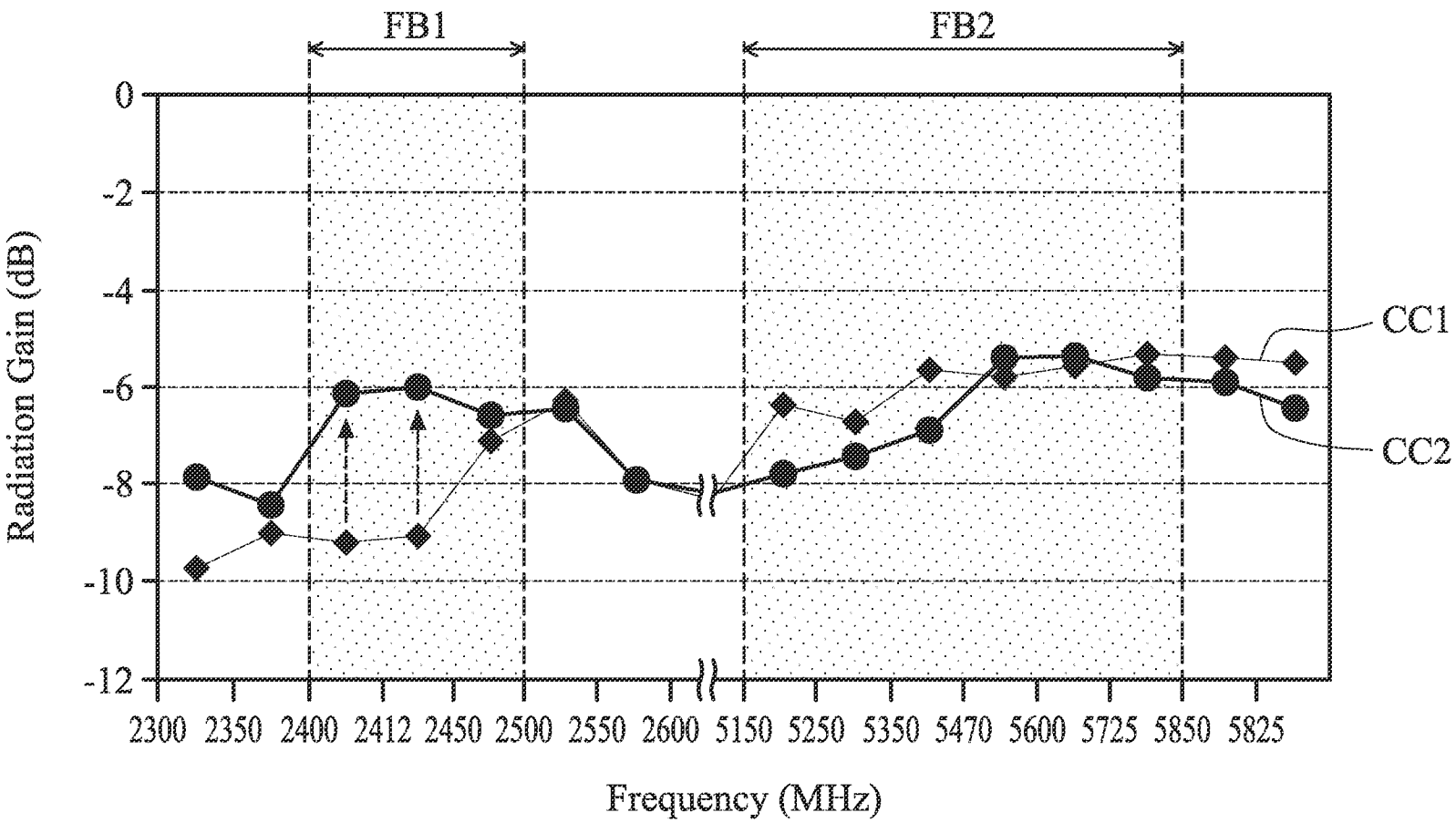
FIG. 4 is a diagram of radiation gain of an antenna structure of a convertible notebook computer according to an embodiment of the invention.

FIG. 4 is a diagram of radiation gain of the antenna structure of the convertible notebook computer 100 according to an embodiment of the invention. The horizontal axis represents the operational frequency (MHz), and the vertical axis represents the radiation gain (dB). As shown in FIG. 4, the convertible notebook computer 100 operates in a tablet mode, where a first curve CC1 represents the operational characteristic of the conventional antenna design, and a second curve CC2 represents the operational characteristic of the antenna structure of the convertible notebook computer 100. According to the measurement of FIG. 4, the antenna structure of the convertible notebook computer 100 can cover a first frequency band FB1 and a second frequency band FB2. The first frequency band FB1 may be from 2400 MHz to 2500 MHz. The second frequency band FB2 may be from 5150 MHz to 5850 MHz. Therefore, the convertible notebook computer 100 can support at least the wideband operations of WLAN (Wireless Local Area Networks) 2.4 GHz/5 GHz.

In some embodiments, the operational principles of the antenna structure of the convertible notebook computer 100 will be described as follows. The closed slot 120 of the metal mechanism element 110 can be excited to generate the first frequency band FB1. The first radiation element 130 and the second radiation element 140 can be excited together to enhance the first frequency band FB1. The first radiation element 130 and the third radiation element 150 can be excited together to generate the second frequency band FB2. In addition, the first parasitic element 160, the second parasitic element 170, and the third parasitic element 180 are configured to fine-tune the impedance matching of the first frequency band FB1 and the second frequency band FB2, thereby increasing their operational bandwidth.

In some embodiments, the element sizes of the convertible notebook computer 100 will be described as follows. The length LS of the closed slot 120 of the metal mechanism element 110 may be substantially equal to 0.5 wavelength ($\lambda/2$) of the first frequency band FB1 of the antenna structure. The width WS of the closed slot 120 of the metal mechanism element 110 may be from 10 mm to 20 mm. The total length L1 of the first radiation element 130 and the second radiation element 140 may be substantially equal to 0.25 wavelength ($\lambda/4$) of the first frequency band FB1 of the antenna structure. The total length L2 of the first radiation element 130 and the third radiation element 150 may be substantially equal to 0.25 wavelength ($\lambda/4$) of the second frequency band FB2 of the antenna structure. The width of each of the first radiation element 130, the second radiation element 140, and the third radiation element 150 may be from 2 mm to 3 mm. The length L3 of the first parasitic element 160 may be from 5 mm to 7 mm. The width W3 of the first parasitic element 160 may be from 5 mm to 10 mm. The length L4 of the second parasitic element 170 may be from 5 mm to 7 mm. The width W4 of the second parasitic element 170 may be from 5 mm to 10 mm. The distance D1 between the second parasitic element 170 and the first parasitic element 160 may be from 15 mm to 25 mm. The length L5 of the third parasitic element 180 may be from 5 mm to 7 mm. The width W5 of the third parasitic element 180 may be from 2 mm to 3 mm. The width of the first coupling gap GC1 may be shorter than or equal to 2 mm. The width of the second coupling gap GC2 may be shorter than or equal to 2 mm. The width of the third coupling gap GC3 may be shorter than or equal to 2 mm. The above ranges of element sizes are calculated and obtained according to the results of many experiments, and they help to optimize the operational bandwidth and impedance matching of the antenna structure of the convertible notebook computer 100.

Figure 5A:
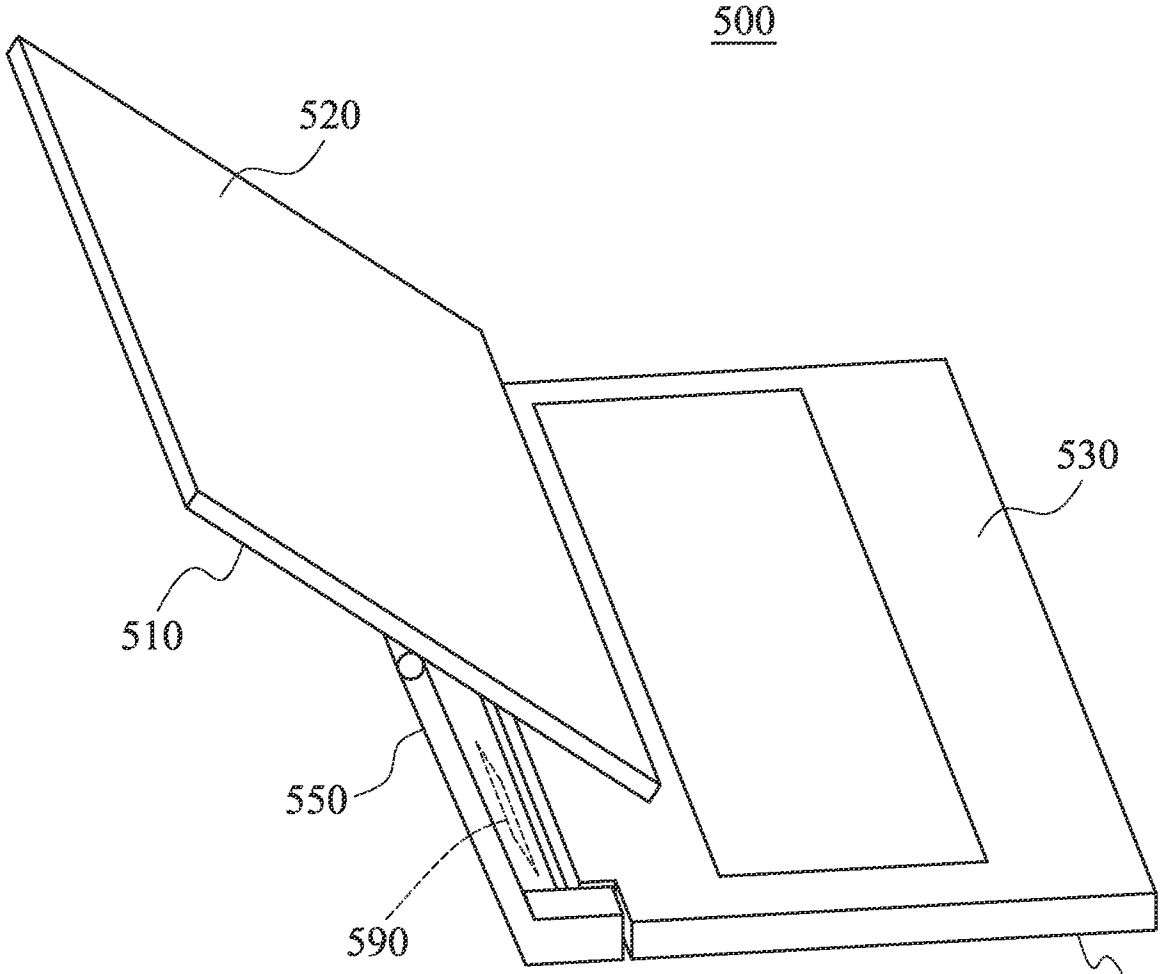
FIG. 5A is a perspective view of a convertible notebook computer operating in a notebook mode according to an embodiment of the invention.
Figure 5B:
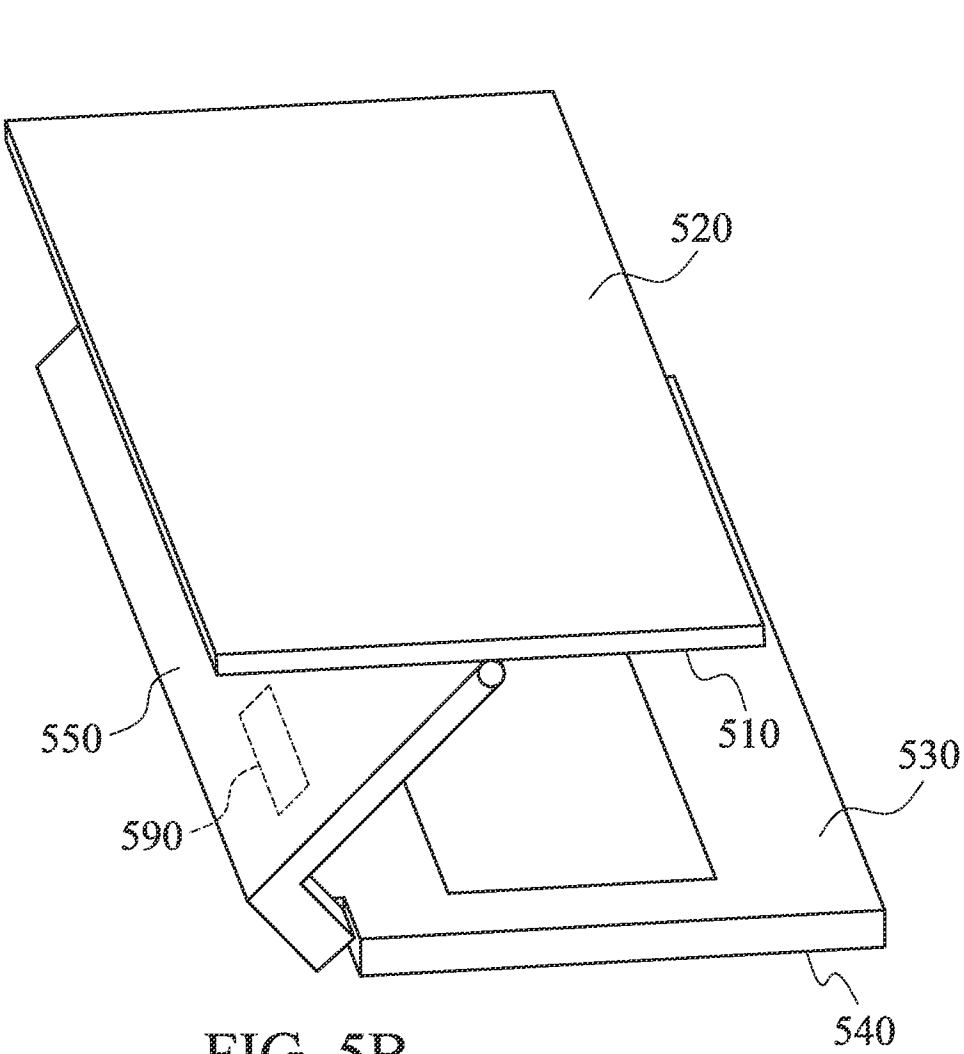
FIG. 5B is a perspective view of a convertible notebook computer operating in a display mode according to an embodiment of the invention.
Figure 5C:
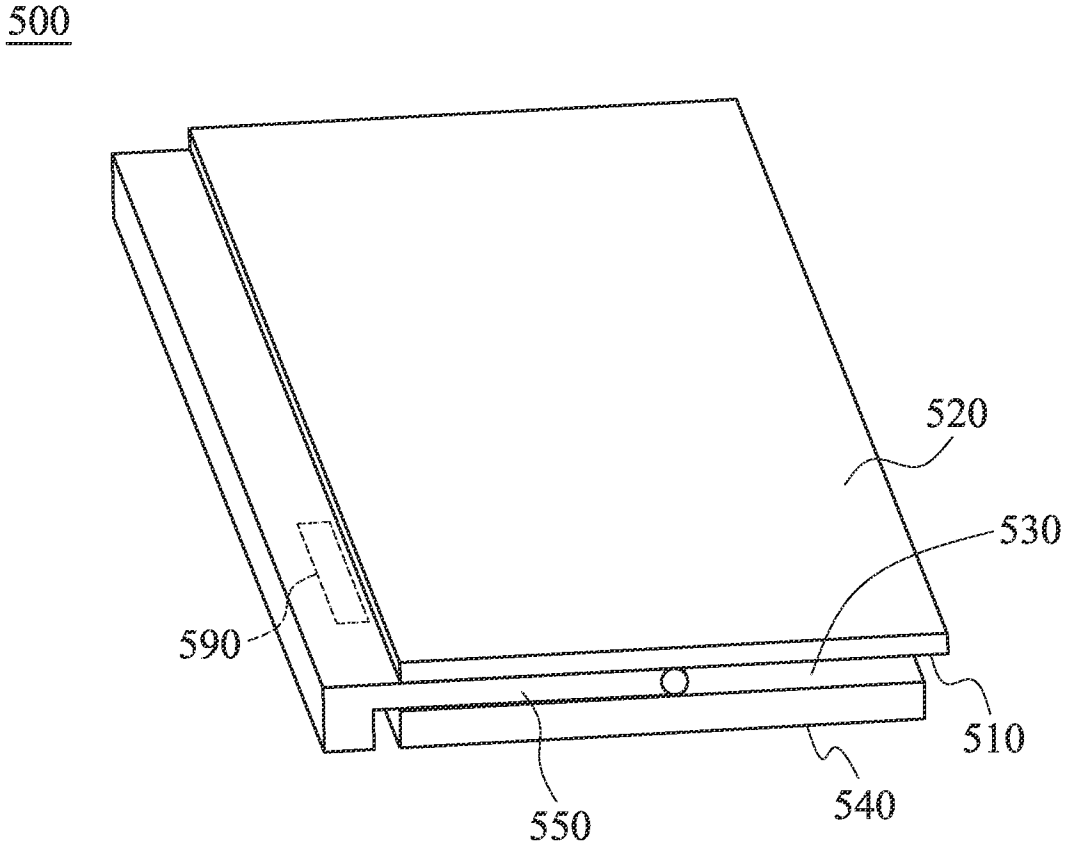
FIG. 5C is a perspective view of a convertible notebook computer operating in a tablet mode according to an embodiment of the invention.

FIG. 5A is a perspective view of a convertible notebook computer 500 operating in a notebook mode according to an embodiment of the invention. FIG. 5B is a perspective view of the convertible notebook computer 500 operating in a display mode according to an embodiment of the invention. FIG. 5C is a perspective view of the convertible notebook computer 500 operating in a tablet mode according to an embodiment of the invention. As shown in FIG. 5A, FIG. 5B and FIG. 5C, the convertible notebook computer 500 further includes an upper cover housing 510, a display frame 520, a keyboard frame 530, a base housing 540, and a supporting and rotating arm 550. The convertible notebook computer 500 can operate in different modes (e.g., more than three modes) by using the supporting and rotating arm 550. It should be understood that the upper cover housing 510, the display frame 520, the keyboard frame 530, and the base housing 540 are equivalent to the so-called "A-component", "B-component", "C-component" and "D-component" in the field of notebook computers, respectively. The aforementioned metal mechanism element 110 and its antenna structure may be positioned at a specific position 590 on the supporting and rotating arm 550. Although the radiation performance of the conventional antenna design may be negatively affected by the metal keyboard frame 530, the proposed design of the invention can solve the problem by changing the current distribution and by adjusting the positions of current nulls. According to practical measurements, the radiation efficiency of the antenna structure can be maintained at an acceptable level even if the convertible notebook computer 500 operates in the tablet mode (i.e., the radiation efficiency of the antenna structure is not decreased so much). Please refer to FIG. 4 again. According to the measurement of FIG. 4, the radiation gain of the proposed antenna structure of the invention is increased by at least about 4 dB within the first frequency band FB1, in comparison to the conventional antenna design. It can meet the requirements of practical application of general mobile communication devices.

The invention proposes a novel convertible notebook computer. According to practical measurements, the radiation performance of the corresponding antenna structure will not be negatively affected so much even if the convertible notebook computer operates in different modes. Compared to the conventional design, the invention has at least the advantages of small size, wide bandwidth, low manufacturing cost, high radiation efficiency, and good communication quality, and therefore it is suitable for application in a variety of mobile communication devices.

Note that the above element sizes, element shapes, and frequency ranges are not limitations of the invention. An antenna designer can fine-tune these settings or values according to different requirements. It should be understood that the convertible notebook computer and antenna structure of the invention are not limited to the configurations of FIGS. 1-5. The invention may merely include any one or more features of any one or more embodiments of FIGS. 1-5. In other words, not all of the features displayed in the figures should be implemented in the convertible notebook computer and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A convertible notebook computer, comprising:

a metal mechanism element, having a closed slot;

a first radiation element, having a feeding point;

a second radiation element, coupled to the first radiation element;

a third radiation element, coupled to the first radiation element, wherein the third radiation element and the second radiation element substantially extend in opposite directions;

a first parasitic element, coupled to a first connection point on the metal mechanism element, and disposed adjacent to the second radiation element;

a second parasitic element, coupled to a second connection point on the metal mechanism element, and disposed adjacent to the third radiation element;

a third parasitic element, coupled to a third connection point on the metal mechanism element, and disposed adjacent to the first radiation element; and a dielectric substrate, wherein the first radiation element, the second radiation element, the third radiation element, the first parasitic element, the second parasitic element, and the third parasitic element are disposed on the dielectric substrate;

wherein an antenna structure is formed by the closed slot of the metal mechanism element, the first radiation element, the second radiation element, the third radiation element, the first parasitic element, the second parasitic element, and the third parasitic element;

wherein the first connection point and the second connection point are positioned at a first edge of the closed slot, wherein the third connection point is positioned at a second edge of the closed slot, and wherein the second edge is opposite to the first edge.

2. The convertible notebook computer as claimed in claim 1, wherein the whole dielectric substrate is inside the closed slot of the metal mechanism element.

3. The convertible notebook computer as claimed in claim 1, wherein a combination of the first radiation element, the second radiation element, and the third radiation element substantially has a T-shape.

4. The convertible notebook computer as claimed in claim 1, wherein a first coupling gap is formed between the first parasitic element and the second radiation element, a second coupling gap is formed between the second parasitic element and the third radiation element, and a third coupling gap is formed between the third parasitic element and the first radiation element.

5. The convertible notebook computer as claimed in claim 4, wherein a width of each of the first coupling gap, the second coupling gap, and the third coupling gap is shorter than or equal to 2 mm.

6. The convertible notebook computer as claimed in claim 1, wherein the antenna structure covers a first frequency band and a second frequency band.

7. The convertible notebook computer as claimed in claim 6, wherein the first frequency band is from 2400 MHz to 2500 MHz, and the second frequency band is from 5150 MHz to 5850 MHz.

8. The convertible notebook computer as claimed in claim 6, wherein a length of the closed slot of the metal mechanism element is substantially equal to 0.5 wavelength of the first frequency band.

9. The convertible notebook computer as claimed in claim 6, wherein a total length of the first radiation element and the second radiation element is substantially equal to 0.25 wavelength of the first frequency band.

10. The convertible notebook computer as claimed in claim 6, wherein a total length of the first radiation element and the third radiation element is substantially equal to 0.25 wavelength of the second frequency band.

11. The convertible notebook computer as claimed in claim 1, further comprising an upper cover housing, a display frame, a keyboard frame, a base housing, and a supporting and rotating arm.

12. The convertible notebook computer as claimed in claim 11, wherein the convertible notebook computer operates in different modes by using the supporting and rotating arm.

13. The convertible notebook computer as claimed in claim 11, wherein the metal mechanism element is disposed on the supporting and rotating arm.

14. The convertible notebook computer as claimed in claim 1, wherein the closed slot is used as an antenna window.

15. The convertible notebook computer as claimed in claim 1, wherein radiation efficiency of the antenna structure is maintained at an acceptable level when the convertible notebook computer operates in a tablet mode.

* * * * *